US011525549B1

(12) United States Patent
Gibbs

(10) Patent No.: US 11,525,549 B1
(45) Date of Patent: Dec. 13, 2022

(54) SOLAR POWERED ILLUMINATION DEVICE

(71) Applicant: Colby Gibbs, Roswell, GA (US)

(72) Inventor: Colby Gibbs, Roswell, GA (US)

( * ) Notice: Subject to any disclaimer, the term of this patent is extended or adjusted under 35 U.S.C. 154(b) by 0 days.

(21) Appl. No.: 17/677,447

(22) Filed: Feb. 22, 2022

(51) Int. Cl.

| | |
|---|---|
| ***F21S 9/03*** | (2006.01) |
| ***F21S 4/10*** | (2016.01) |
| ***F21V 9/08*** | (2018.01) |
| *F21W 121/00* | (2006.01) |

(52) U.S. Cl.
CPC ..... *F21S 9/037* (2013.01); *F21S 4/10* (2016.01); *F21V 9/08* (2013.01); *F21W 2121/00* (2013.01)

(58) Field of Classification Search
CPC .. F21S 9/032; F21S 9/035; F21S 9/037; F21S 4/10; F21S 4/15
See application file for complete search history.

(56) References Cited

U.S. PATENT DOCUMENTS

2012/0314404 A1* 12/2012 Harshaw ..... F21V 7/0025 362/183

* cited by examiner

*Primary Examiner* — Sean P Gramling
(74) *Attorney, Agent, or Firm* — The Iwashko Law Firm, PLLC; Lev Ivan Gabriel Iwashko

(57) ABSTRACT

A solar powered illumination device, including a bulb to illuminate in at least one color, a base unit removably connected to the bulb to receive the bulb therein, a solar cell circumferentially disposed around at least a portion of the base unit to generate power in response to receiving an external light source and send the power to the bulb, and a connector unit, including a connector body removably connected between the bulb and the base unit, and a photodiode disposed on at least a portion of the connector body to generate power for the bulb in response to receiving the external light source thereon.

3 Claims, 3 Drawing Sheets

SOLAR POWERED ILLUMINATION DEVICE

BACKGROUND

1. Field

The present general inventive concept relates generally to an illumination device, and particularly, to a solar powered illumination device.

2. Description of the Related Art

During a holiday season, many people enjoy setting up decorative light displays. However, arranging the decorative light display can be a daunting task depending on how much lighting is used and the amount of detail. Moreover, most decorative light displays require special positioning.

The difficulty in setting up the decorative light display often requires using long power cords to provide sufficient access to a power source. Additionally, the decorative light display may have multiple plugs that are not always able to reach a power outlet, which can make the arrangement inconvenient.

Therefore, there is a need for a solar powered illumination device that is not dependent on the power outlet to receive power and be self-sufficient.

SUMMARY

The present general inventive concept provides a solar powered illumination device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a solar powered illumination device, including a bulb to illuminate in at least one color, a base unit removably connected to the bulb to receive the bulb therein, a solar cell circumferentially disposed around at least a portion of the base unit to generate power in response to receiving an external light source and send the power to the bulb, and a connector unit, including a connector body removably connected between the bulb and the base unit, and a photodiode disposed on at least a portion of the connector body to generate power for the bulb in response to receiving the external light source thereon.

The photodiode may be configured to receive a wide range of wavelengths of radiation to generate power.

The photodiode may receive at least one of visible light, UV, infrared, gamma, and x-ray.

The connector unit may further include a plurality of wire receiving apertures disposed on and within at least a portion of the photodiode to receive at least one of a plurality of wires from the bulb therethrough, and a plurality of prongs disposed on at least a portion of the connector body to connect the plurality of wires from the bulb to the solar cell.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1A:
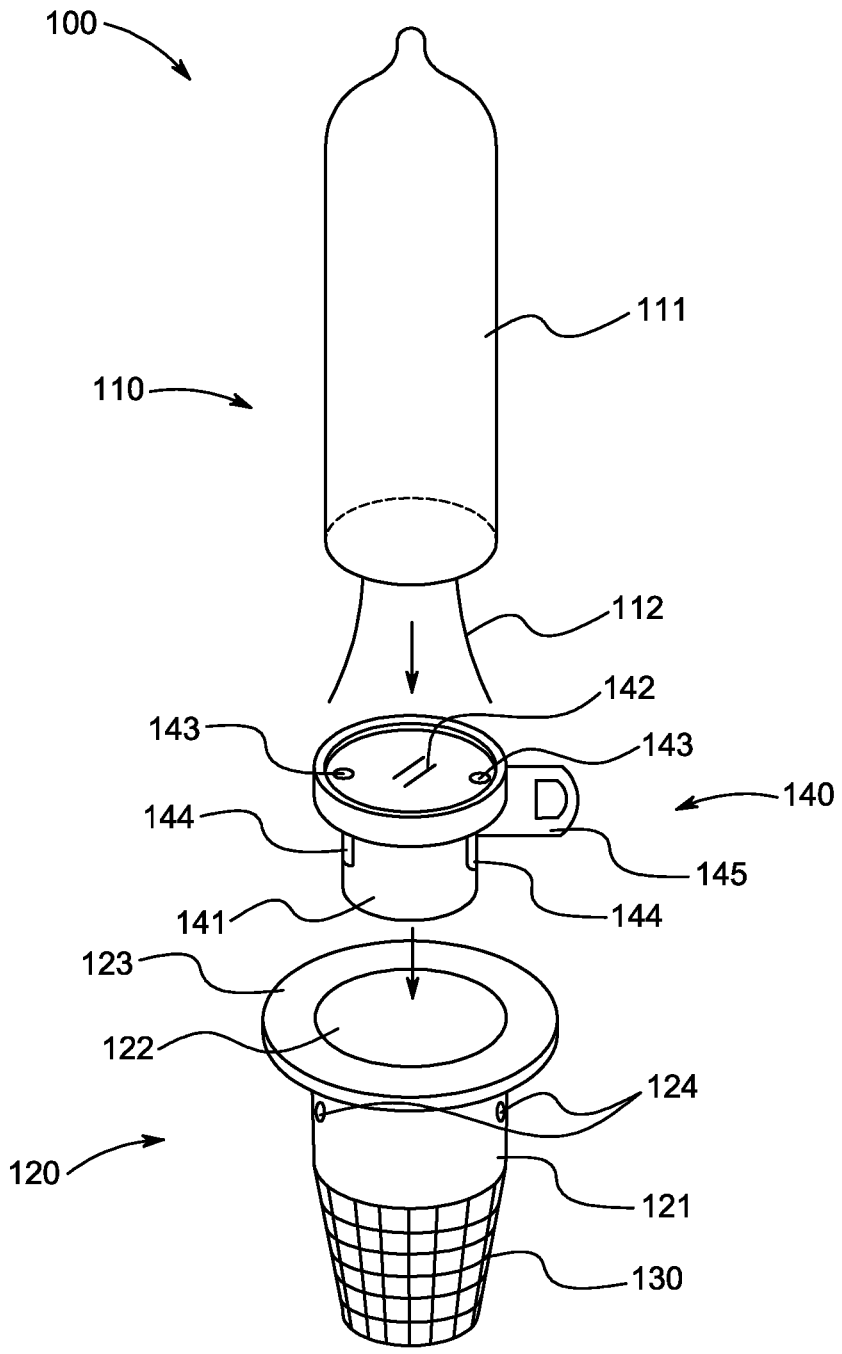
FIG. 1A illustrates an exploded view of a solar powered illumination device, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Solar Powered Illumination Device 100
Bulb 110
Bulb Body 111
Wires 112
Base Unit 120

Receiving Body 121
Bulb Receiving Aperture 122
Lip 123
Prong Receiving Apertures 124
Solar Cell 130
Connector Unit 140
Connector Body 141
Photodiode 142
Wire Receiving Apertures 143
Prongs 144
Handle 145

FIG. 1A illustrates an exploded view of a solar powered illumination device 100, according to an exemplary embodiment of the present general inventive concept.

Figure 1B:
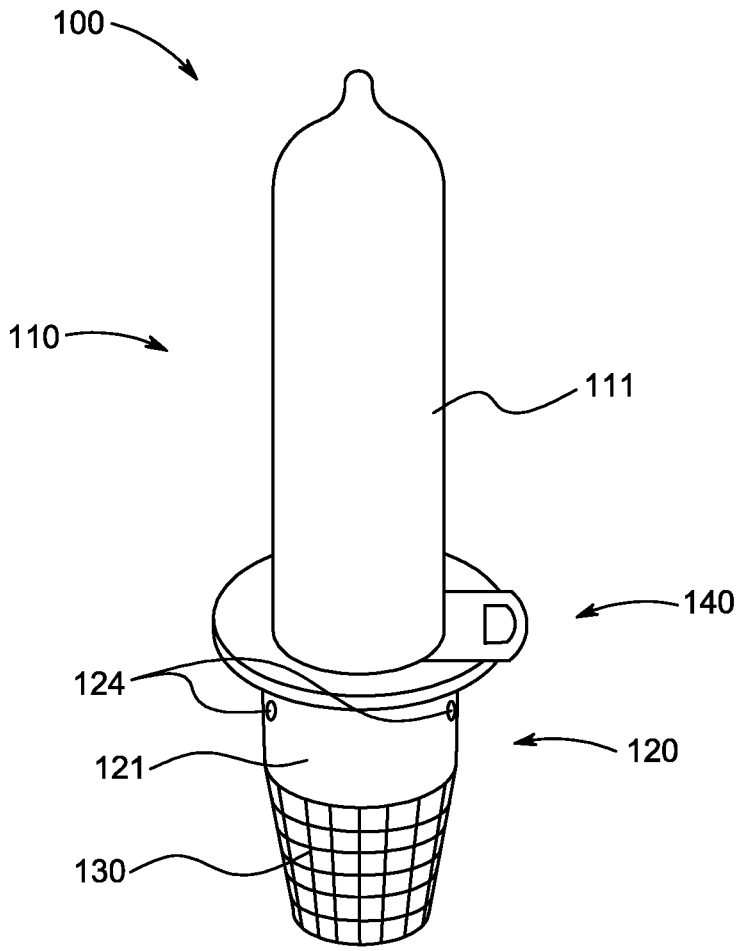
FIG. 1B illustrates a top perspective view of the solar powered illumination device, according to an exemplary embodiment of the present general inventive concept.

FIG. 1B illustrates a top perspective view of the solar powered illumination device 100, according to an exemplary embodiment of the present general inventive concept.

The solar powered illumination device 100 may be constructed from at least one of metal, plastic, wood, and rubber, etc., but is not limited thereto.

The solar powered illumination device 100 may include a bulb 110, a base unit 120, a solar cell 130, and a connector unit 140, but is not limited thereto.

The bulb 110 may include a bulb body 111 and a plurality of wires 112, but is not limited thereto.

Referring to FIGS. 1A and 1B, the bulb body 111 is illustrated to have an elongated bulb shape. However, the bulb body 111 may be rectangular, circular, spherical, triangular, pentagonal, hexagonal, heptagonal, octagonal, or any other shape known to one of ordinary skill in the art, but is not limited thereto.

The bulb body 111 may include an incandescent bulb, a light-emitting diode (LED), a halogen bulb, a fluorescent bulb, and a processing unit (e.g., a microcontroller), but is not limited thereto.

The bulb body 111 may illuminate a single color and/or a plurality of colors based on programming of the processing unit. Moreover, the bulb body 111 may illuminate in a variety of different methods, such as flashing, blinking, strobe, and/or infrared.

The plurality of wires 112 may be disposed on at least a portion of the bulb body 111. Additionally, the plurality of wires 112 may extend away from the bulb body 112 with respect to a direction.

The base unit 120 may include a receiving body 121, a bulb receiving aperture 122, a lip 123, and a plurality of prong receiving apertures 124, but is not limited thereto.

The receiving body 121 may store the bulb body 111 and/or the plurality of wires 112 therein.

The bulb receiving aperture 122 may be disposed within at least a portion of the receiving body 121. The bulb receiving aperture 122 may receive and/or removably connect to the bulb body 111 and/or the plurality of wires 112 therethrough. In other words, the bulb body 111 and/or the plurality of wires 112 may be inserted into the receiving body 121 through the bulb receiving aperture 122.

The lip 123 may be circumferentially disposed in a circle on at least a portion of an edge at a first end of the receiving body 121, such that the lip 123 may surround a perimeter of the edge of the receiving body 121. Also, the lip 123 may have a circumference greater than a circumference of the bulb receiving aperture 122.

Each of the plurality of prong receiving apertures 124 may be disposed on at least a portion of the receiving body 121 between the first end of the receiving body 121 and a second end of the receiving body 121 opposite with respect to the first end.

The solar cell 130 may include a battery, but is not limited thereto.

The solar cell 130 may be circumferentially disposed around at least a portion of the second end of the receiving body 121 and/or within the receiving body 121. The solar cell 130 may generate power in response to receiving an external light source (e.g., ultraviolet light), and send the power to the battery.

The connector unit 140 may include a connector body 141, a photodiode 142, a plurality of wire receiving apertures 143, a plurality of prongs 144, and a handle 145, but is not limited thereto.

The connector body 141 be removably connected to at least a portion of the bulb body 111 and/or the receiving body 121. Moreover, the connector body 141 may be connected between the bulb body 111 and/or the receiving body 121.

The photodiode 142 may be disposed on at least a portion of the connector body 141. The photodiode 142 may generate power for the bulb body 111 in response to receiving the external light source thereon. Also, the photodiode 142 may be configured to receive a wide range of wavelengths of radiation (e.g., violet, indigo, blue, green, yellow, orange, red, visible light, UV, infrared, gamma, x-ray) to generate power.

The plurality of wire receiving apertures 143 may be disposed on and/or within at least a portion of the photodiode 142. Each of the plurality of wire receiving apertures 143 may receive at least one of the plurality of wires 112 therethrough.

The plurality of prongs 144 may be disposed on at least a portion of the connector body 141. Each of the plurality of prongs 144 may removably connect to the plurality of wires 112 inserted within the plurality of wire receiving apertures 143. In other words, the plurality of wires 112 may removably connect to each of the plurality of prongs 144 within the connector body 141.

Furthermore, the plurality of prongs 144 may removably connect to at least a portion of the solar cell 130 within the receiving body 121 and/or the plurality of prong receiving apertures 124. As such, the plurality of prongs 144 may transfer power generated from the solar cell 130 to the plurality of wires 112 to illuminate the bulb body 111.

The handle 145 may be disposed on at least a portion of connector body 141. The handle 145 may protrude away from the connector body 141 and/or facilitate gripping thereof.

Figure 2:
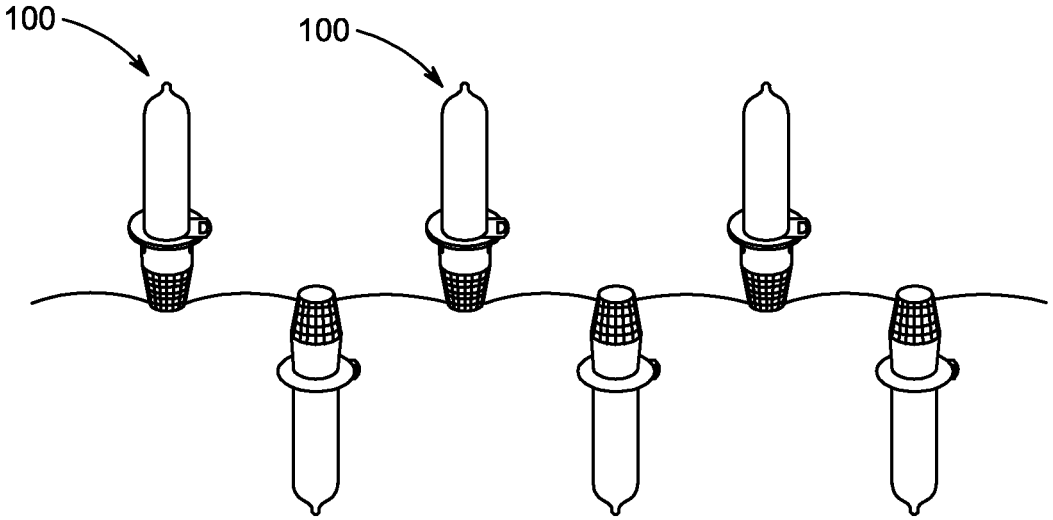
FIG. 2 illustrates a side perspective view of a plurality of solar powered illumination devices, according to an exemplary embodiment of the present general inventive concept.

FIG. 2 illustrates a side perspective view of a plurality of solar powered illumination devices 100, according to an exemplary embodiment of the present general inventive concept.

The solar powered illumination device 100 may be connected via an external wire to at least one other solar powered illumination device 100. Thus, the solar powered illumination device 100 may be used as seasonal lighting (e.g., Christmas lights).

Therefore, the solar powered illumination device 100 may be self-sufficient due to requiring the external light source to generate power rather than positioning of a power cord and a power outlet. Also, the solar powered illumination device 100 may facilitate use of decorative lighting due to not requiring the power cord.

The present general inventive concept may include a solar powered illumination device 100, including a bulb 110 to illuminate in at least one color, a base unit 120 removably connected to the bulb 110 to receive the bulb 110 therein, a solar cell 130 circumferentially disposed around at least a portion of the base unit 120 to generate power in response to receiving an external light source and send the power to the bulb 110, and a connector unit 140, including a connector body 141 removably connected between the bulb 110 and the base unit 120, and a photodiode 142 disposed on at least a portion of the connector body 141 to generate power for the bulb 110 in response to receiving the external light source thereon.

The photodiode 142 may be configured to receive a wide range of wavelengths of radiation to generate power.

The photodiode 142 may receive at least one of visible light, UV, infrared, gamma, and x-ray.

The connector unit 140 may further include a plurality of wire receiving apertures 143 disposed on and within at least a portion of the photodiode 142 to receive at least one of a plurality of wires 112 from the bulb 110 therethrough, and a plurality of prongs 144 disposed on at least a portion of the connector body 141 to connect the plurality of wires 112 from the bulb 110 to the solar cell 130.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A solar powered illumination device, comprising:

a bulb to illuminate in at least one color;

a base unit removably connected to the bulb to receive the bulb therein;

a solar cell circumferentially disposed around at least a portion of the base unit to generate power in response to receiving an external light source and send the power to the bulb; and a connector unit, comprising:

a connector body removably connected between the bulb and the base unit, a photodiode disposed on at least a portion of the connector body to generate power for the bulb in response to receiving the external light source thereon, a plurality of wire receiving apertures disposed on and within at least a portion of the photodiode to receive at least one of a plurality of wires from the bulb therethrough, and a plurality of prongs disposed on at least a portion of the connector body to connect the plurality of wires from the bulb to the solar cell.

2. The solar powered illumination device of claim 1, wherein the photodiode is configured to receive a wide range of wavelengths of radiation to generate power.

3. The solar powered illumination device of claim 1, wherein the photodiode receives at least one of visible light, UV, infrared, gamma, and x-ray.

* * * * *